US006349637B1

(12) United States Patent
Molteni

(10) Patent No.: US 6,349,637 B1
(45) Date of Patent: Feb. 26, 2002

(54) CALENDER WITH MAGNETIC DEVICE FOR ADJUSTING THE CONTACT PRESSURE BETWEEN THE ROLLS

(75) Inventor: Danilo Molteni, Manerbio (IT)

(73) Assignee: SGM, S.p.A., Manerbio (IT)

( * ) Notice: Subject to any disclaimer, the term of this patent is extended or adjusted under 35 U.S.C. 154(b) by 0 days.

(21) Appl. No.: 09/664,034

(22) Filed: Sep. 18, 2000

Related U.S. Application Data

(63) Continuation of application No. PCT/IT00/00037, filed on Feb. 8, 2000, now abandoned.

(30) Foreign Application Priority Data

Feb. 9, 1999 (IT) ..... MI99A0248

(51) Int. Cl.[7] ..... B30B 3/04

(52) U.S. Cl. ..... 100/168; 100/47; 100/153; 100/330; 100/917

(58) Field of Search ..... 100/47, 92, 153, 100/168, 169, 176, 330, 332, 917

(56) References Cited

U.S. PATENT DOCUMENTS 3,413,915 A * 12/1968 Goodwin et al. ..... 100/169
3,456,582 A 7/1969 McClenathan
3,489,079 A * 1/1970 Aurich et al. ..... 100/168
3,556,000 A 1/1971 Goodwin et al.
4,384,514 A * 5/1983 Larive et al. ..... 100/47
4,425,489 A * 1/1984 Pav et al. ..... 100/330
4,621,177 A * 11/1986 Pulkowski et al. ..... 100/92
4,631,794 A * 12/1986 Riihinen ..... 100/917
4,675,487 A * 6/1987 Verkasalo ..... 100/332
4,704,191 A * 11/1987 Wedel ..... 100/917
5,344,520 A * 9/1994 Seki et al.
5,392,702 A * 2/1995 Suzuki ..... 100/168
5,685,929 A * 11/1997 Bettinelli et al. ..... 100/47
5,782,177 A * 7/1998 Rindfleisch ..... 100/168

FOREIGN PATENT DOCUMENTS

EP 0 188 399 A1 7/1986

* cited by examiner

*Primary Examiner*—Scott A. Smith
*Assistant Examiner*—Louis Huynh
(74) *Attorney, Agent, or Firm*—Akin, Gump, Strauss, Hauer & Feld, L.L.P.

(57) ABSTRACT

A magnetic calender comprises a pair of rotatable parallel rolls (1, 2) and an electromagnet provided with two pole pieces (6, 7) extending parallel to the rolls (1, 2) and joined to a common base (5) through a plurality of magnetic cores (8) having an arrangement which is specularly symmetrical with respect to both the transverse mid-plane and the longitudinal mid-plane of the calender. A coil (9) and a control solenoid (10) located adjacent to the relevant pole piece (6, 7) are wound around each of the cores (8), and the intensity of the current circulating in the coil (9) is controlled by an adjusting unit (11) which is in turn controlled by a control unit (12) which receives and processes the magnetic flux reading carried out by the control solenoid (10).

7 Claims, 3 Drawing Sheets

CALENDER WITH MAGNETIC DEVICE FOR ADJUSTING THE CONTACT PRESSURE BETWEEN THE ROLLS

CROSS-REFERENCE TO RELATED APPLICATIONS

This application is a continuation of International Application No. PCT/IT00/00037 filed Feb. 8, 2000, now abandoned. The disclosure of which is incorporated herein by reference.

BACKGROUND OF THE INVENTION

The present invention related to calenders, and in particular to a magnetic calender provided with a device for adjusting the contact pressure between the rolls.

The calender is know to be a machine manufactured in many different types for exerting a laminating action on various types of materials (paper, rubber, fabrics, etc.), which as finished product are in the form of continuous sheets or tapes. By means of a calender it is possible to flatten, shape, couple, taper or superficially finish in various ways one or more sheets of material passed through a pair of counterrotating parallel rolls. Such rolls are pressed against each other with a variable load depending upon the type of material and of process to be carried out, and they are generally hollow so as to allow their heating and/or cooling by means of an inner circulation of fluid.

In prior art calenders the contact pressure between the rolls is generated by driving them against each other by means of mechanical or hydraulic devices acting at the rotation and support pivots. However, this conventional arrangement does not ensure the uniformity of the pressure along the entire contact line, in particular for rolls of some length. In fact, the thrust exerted on the pivots obviously decreases upon increasing of the distance from the support, so that the rolls are generally convex at the center in order to make up for the decreased thrust in said area.

This conventional solution has various drawbacks affecting both the machine working and the product quality. First, the non-uniform pressure causes vibrations and accordingly noisiness, as well as a consequent non-uniform wear of the rolls. Furthermore, the control of the contact pressure is neither easy nor precise because they may be an excessive pressure at some points and/or an insufficient pressure at some others.

As far as the product is concerned, the material being pressed with a pressure varying along its transversal dimension is not perfectly uniform. Moreover, in a determined point the pressure may also change in time due to the irregular wear, to settling, etc. so that a batch of material may be treated in a slightly different way than the subsequent one.

A partial overcoming of these drawbacks is achieved by the magnetic calender, wherein the contact pressure between the rolls is obtained by means of a magnet generating a magnetic flux which is constant along the whole length of the rolls, which are made of a paramagnetic or ferromagnetic material. The magnet is provided with pole pieces extending along the whole length of the rolls so as to achieve an almost constant pressure along the line of contact between the rolls.

However, even this arrangement does not provide the best operation in the most common case where the calender is used to process materials which may have different widths, whereby the rolls do not work along their whole length but just on the length contacting the material. As a result, in the end portions where there is no material to be pressed the rolls tend to touch thus causing an unevenness of the pressure. In fact, the closing in of the rolls causes a reduction of the gap towards the polar pieces and therefore an increase in the magnetic induction, with a subsequent increase in the force of attraction between the rolls which is proportional to the square of the induction.

In practice, the phenomenon which occurs is the so-called "magnetic instability" which causes a change in the contact pressure and therefore unevenness in the processing of the material.

In order to adapt somewhat the calender to the width of the material to be processed, magnets have been devised which are divided into a plurality of independent mobile portions. However, such an arrangement has a significant mechanical complexity and implies a quite difficult adjusting procedure. Moreover, the results which can be achieved are not very satisfactory in that there is no control on the actual evenness of the pressure and the above-mentioned magnetic instability phenomenon can not be prevented.

SUMMARY OF THE INVENTION

The object of the present invention is therefore to provide a magnetic calender provided with a device for adjusting the contact pressure which overcomes the aforementioned drawbacks.

Such an object is achieved by means of an adjusting device which detects the flux changes in each of the cores into which the roll-pulling electromagnet is divided, and adjusts the intensity of the magnetomotive force (m.m.f.) of each core so as to prevent the magnetic instability and generate a constant and uniform magnetic flux along the whole roll length.

The main advantage of the device according to the present invention is therefore that of generating a perfectly even and constant contact pressure between the calender rolls thanks to the "trimming" capacity provided by the adjusting device. In this way the vibrations, the noisiness and the production defects are greatly reduced and the wear as well is uniform. Furthermore, a high treatment reproducibility is obtained, so that consecutive batches of material are far more homogeneous since the production conditions are constant.

A second advantage of the present calender is that it achieves a perfectly even heating of the rolls due to the eddy currents (so-called Foucault's currents) which are generated on the surface of the rolls through the effect of the magnetic field rotating with respect thereto. Since such a heating is uniform along the contact line, it contributes as well to make the working conditions uniform.

Moreover, this adjusting device is much simpler and cheaper to manufacture than an mechanical device, and it allows to easily implement an automatic system for process adjusting and for recording the working parameters.

BRIEF DESCRIPTION OF THE SEVERAL VIEWS OF THE DRAWINGS

These and other advantages and features of the calender according to the present invention will be evident to those skilled in the art by the following detailed description of an embodiment thereof with reference to the attached drawings, wherein.

DETAILED DESCRIPTION OF THE INVENTION

Figure 1:
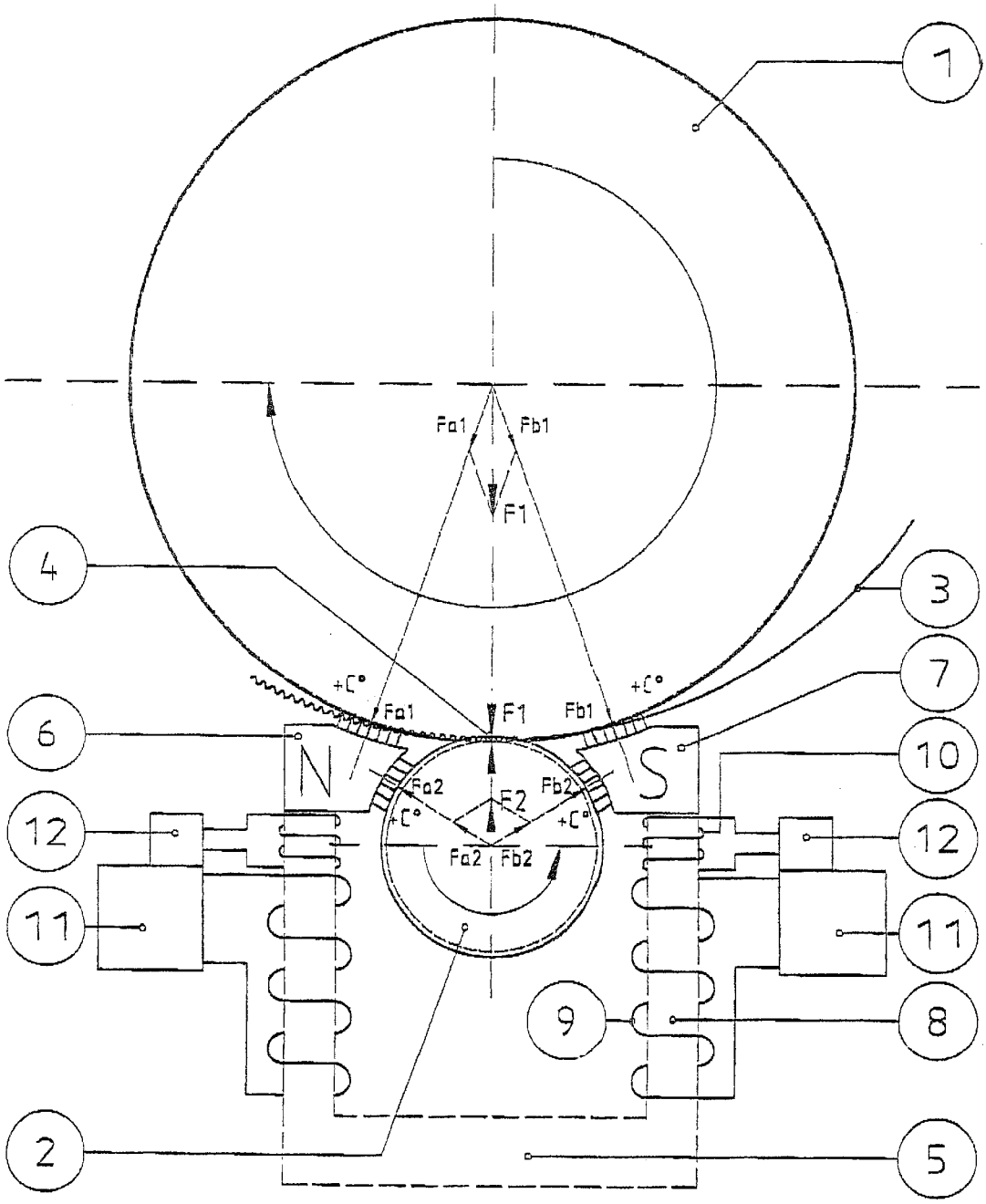
FIG. 1 is a schematic cross-sectional view of the calender.

Referring to such drawings, there is described the operation of a calender according to the present invention especially intended for the production of corrugated board. What hereinafter disclosed is obviously just by way of non-limiting example, since it could be applied, with suitable modifications, to other types of calender, as mentioned above. Examples of other applications are embossing, coupling of different sheets (rubberized fabrics, plastificated papers, etc.), stretching, surface finishing and so on.

The calender depicted in the drawings comprises an upper roll 1 and a lower roll 2 provided with longitudinal toothing and rotating clockwise and counter-clockwise, respectively, as indicated by the relevant arrows. The two rolls 1, 2 are engaged with each other as a pair of gears and a cardboard sheet 3 passing therethrough accordingly takes on a corrugated form. In order to obtain this, the pressure between the rolls along the contact line 4 is about 20–40 kN per meter and their temperature approximately ranges from 130° C. to 200° C.

The contact pressure is generated through a substantially U-shaped electromagnet arranged in a symmetric position below the lower roll 2 so as to have a pole piece 6 (North) on the outlet side of the material and a pole piece 7 (South) on the inlet side. The two pole pieces 6, 7, having an equal and constant cross-section, extend parallel to rolls 1, 2 along the whole length L thereof and they are joined to a common base 5 through a plurality of magnetic cores 8.

Figure 2:
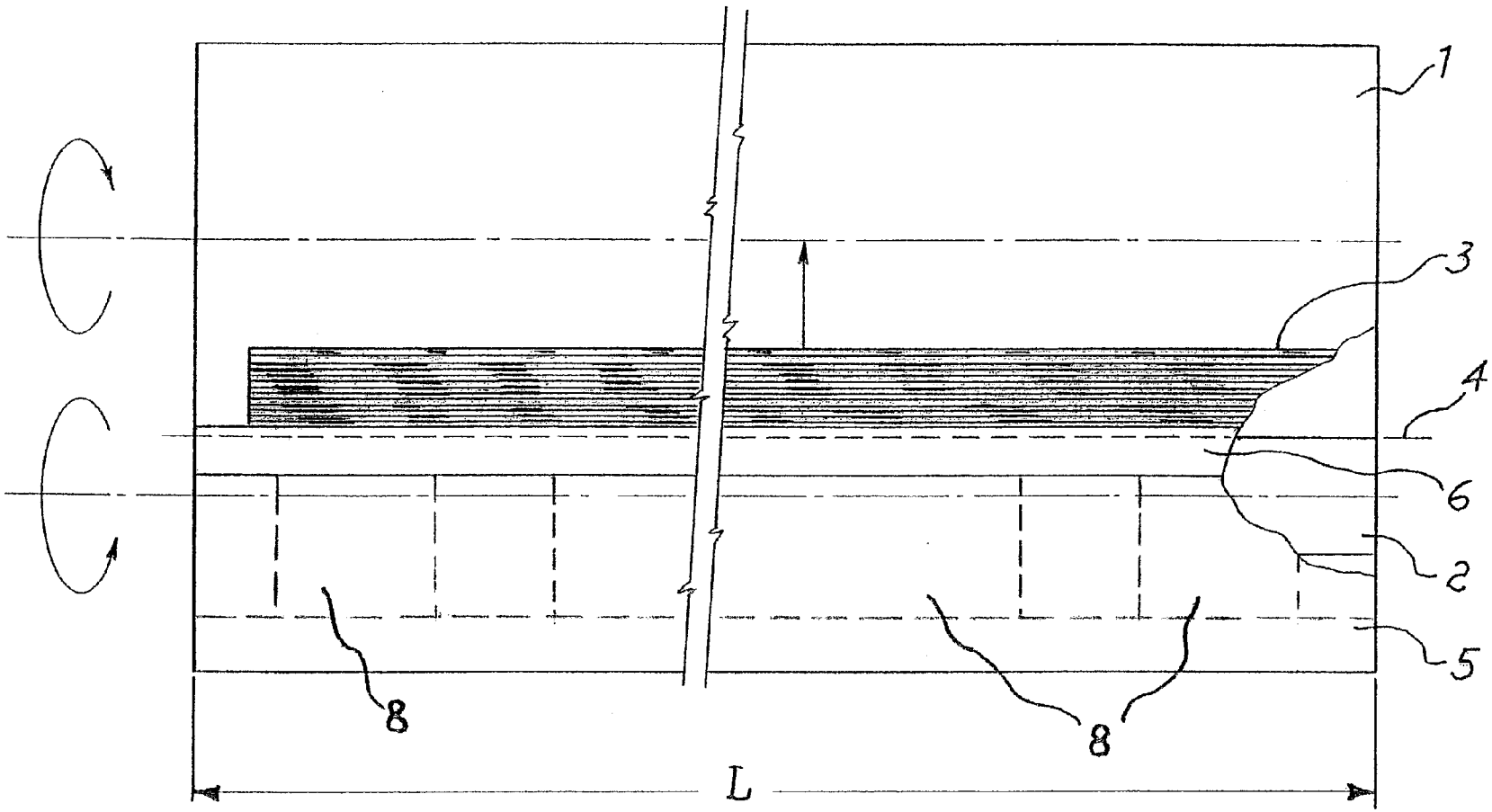
FIG. 2 is a schematic view of said calender on the outlet side of the processed material.
Figure 3:
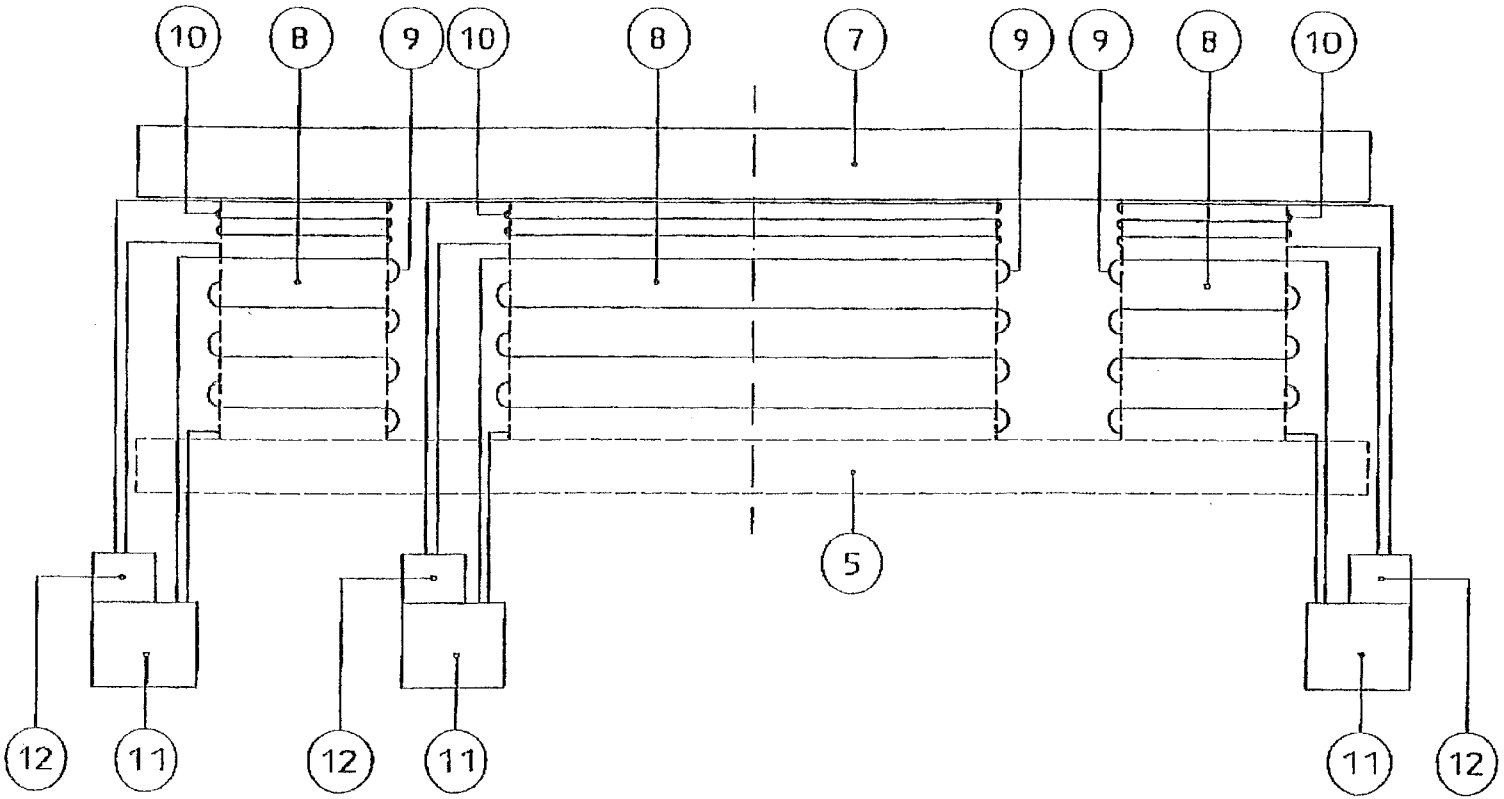
FIG. 3 is a schematic side view of the electromagnet with its relevant adjusting device.

As clearly shown in FIG. 2, the cores 8 have a specularly symmetrical arrangement with respect to the transverse mid-plane with the central core arranged across said plane. In practice, the cores 8 are preferably present in an odd number (three, five, seven, or more) and of decreasing length from the central core to the end ones, whereas their width and height is constant. In this way, thanks also to the symmetry of pole pieces 6 and 7, the calender has a double specular symmetry with respect to the above-mentioned transverse plane and also with respect to the longitudinal mid-plane.

Each pole piece 6, 7 exerts on both rolls 1, 2 a force of magnetic attraction in a perpendicular direction with respect to its surface, such forces being indicated by arrows Fa1, Fa2, Fb1 and Fb2, respectively.

Thanks to the structural symmetry of the device, the attraction components acting on rolls 1, 2 in the horizontal direction cancel each other, whereas those acting in the vertical direction add to each other resulting in attraction forces F1, F2. The pressure along the contact line 4 is thus equal to F1+F2, such a pressure being uniform along the whole length L of rolls 1, 2.

It should be noted that the contact pressure would be nonetheless generated even if one of rolls 1, 2 was made of a non-magnetic material. In such case it would be equal only to F1 or F2, since the non-magnetic material. In such case it would be equal only to F1 or F2, since the non-magnetic roll would provide only the reaction force of its support and rotation pivots.

It is clear that if rolls 1, 2 have a different length and/or the width of material 3 being processed is shorter than the length of the rolls, the important thing is that the pressure be uniform throughout the working contact length L'<L, i.e. the roll length actually working. The adjusting device described hereafter is used to this purpose.

A coil 9 for generating the m.m.f. and a control solenoid 10 located adjacent to the relevant pole piece 6, 7 are wound around each core 8. The intensity of the current circulating in coil 9 (and therefore of the m.m.f. generated thereby) is controlled by a relevant adjusting unit 11, which is in turn controlled by a control unit 12 which receives and processes the magnetic flux reading carried out by solenoid 10.

With such an arrangement, solenoid 10 is able to detect possible changes in the flux linked therewith and generated by coil 9, said flux being the flux passing through core 8 to the pole piece and defining the attraction between rolls 1 and 2. This change in flux is determined, both in amplitude and sign, by the control unit 12 and used to control the adjusting unit 11 so as to compensate said change through a corresponding change in the current of coil 9. In other words, unit 12 allows to restore the present flux value for the relevant core 8 so that the m.m.f. remains unchanged.

It is clear that rather than having a control unit 12 for each adjusting unit 11 it would also be possible to use a single central control unit, which receives the readings carried out by all solenoids 10 and is able to control all the adjusting units 11.

It should be noted that rolls 1, 2, through the effect of their rotation, lie in a rotating magnetic field which generates on their surface eddy currents which are sufficient to heat them of some tens of degrees. In fact, considering that the peripheral roll speed is about 4–5.5 m/s, there is a frequency of sinusoidal electromagnetic variation of about 25–35 Hz, with a value of overall flux of 0.8–1.2 $Wb/m^2$, obviously constant throughout the length acting on the material.

This effect allows to reduce the energy consumption for heating the rolls from inside by means of steam or other fluid, and furthermore it makes the heating more uniform. The contribution provided by the eddy currents depends upon the aforementioned parameters of intensity and frequency of magnetic field variation, as well as upon the conductivity of the roll material.

The herein described and illustrated embodiment of the calender according to the invention is obviously just an example liable to many variations. In particular the shape, the size and the position of rolls 1, 2 and of the other members (5, 6, 7, 8, 9, 10, 11, 12) making up the electromagnet may be somewhat changed according to the specific needs. Likewise, the calender may comprise a greater number of rolls and magnets, and the rolls may be put side by side horizontally instead of vertically or they may be arranged with a vertical or inclined axis instead of a horizontal axis.

I claim:

1. A magnetic calender comprising at least a pair of rotatable parallel rolls and at least an electromagnet provided with two pole pieces extending parallel to said rolls at least along a useful contact length, wherein said pole pieces are joined to a common base through a plurality of magnetic cores having an arrangement which is specularly symmetrical with respect to both a transverse mid-plane and a longitudinal mid-plane of the calendar, a coil and a control solenoid located adjacent to the relevant pole pieces being wound around each of said cores, an adjusting unit connected to said coil for controlling an intensity of a current circulating in said coil, and a control unit conected to said control solenoid for receiving and processing a magnetic flux reading carried out by said control solenoid so as to in turn control said adjusting unit for controlling the intensity of the current circulating in said coil.

2. The calender according to claim 1, wherein each pole piece is joined to the base through an odd number of magnetic cores.

3. The calender according to claim 1, wherein the various magnetic cores have different lengths.

4. The calender according to claim 2, wherein the magnetic cores have decreasing length from a central core to end cores.

5. The calender according to claim 1, wherein each adjusting unit is controlled by a relevant control unit.

6. The calender according to claim 1, wherein all of the adjusting units are controlled by a single control unit.

7. The calender according to claim 1, wherein the rolls are provided with a longitudinal toothing and are engaged with each other as a pair of gears.

* * * * *